US005483431A

United States Patent [19]

Ziliani

[11] Patent Number: 5,483,431

[45] Date of Patent: Jan. 9, 1996

[54] LIGHTING APPARATUS SHIPPABLE IN A FLAT CONDITION

[76] Inventor: Roberto Ziliani, Via Matteo Bartoli, 137 Rome, Italy

[21] Appl. No.: 144,145

[22] Filed: Oct. 27, 1993

[30] Foreign Application Priority Data

May 28, 1993 [IT] Italy ..... RM93U0104

[51] Int. Cl.[6] ..... F21V 21/00

[52] U.S. Cl. ..... 362/382; 362/450; 362/806

[58] Field of Search ..... 362/351–353, 362/362, 382, 450, 812, 392, 806, 810

[56] References Cited

U.S. PATENT DOCUMENTS

| | | | |
|---|---|---|---|
| 2,754,412 | 7/1956 | Noguchi | 362/353 |
| 3,689,762 | 9/1972 | Shatan | 362/352 |
| 3,796,869 | 3/1974 | Stone | 362/812 |
| 4,167,034 | 9/1979 | Noguchi | 362/352 |
| 4,688,155 | 8/1987 | Huang | 362/352 |

*Primary Examiner*—James C. Yeung
*Assistant Examiner*—Sara S. Raab
*Attorney, Agent, or Firm*—Lieberman & Nowak

[57] ABSTRACT

The present invention concerns a lamp which can be assembled easily by the end user and is generally made up of a socket element, a housing element, and an internal element. The housing element is capable of assuming two positions: a shipping position, in which the housing is flat, and an assembled position, in which the housing element is not flat and is capable of supporting the lamp fixture. The socket element is supported by the internal element which in turns helps maintain the housing element in its assembled position. Preferably, the housing element is composed of a front layer and a back layer which are coupled on at least two peripheral edges. In the assembled position these layers are separated forming an internal space in which the internal element and the socket element are located.

17 Claims, 4 Drawing Sheets

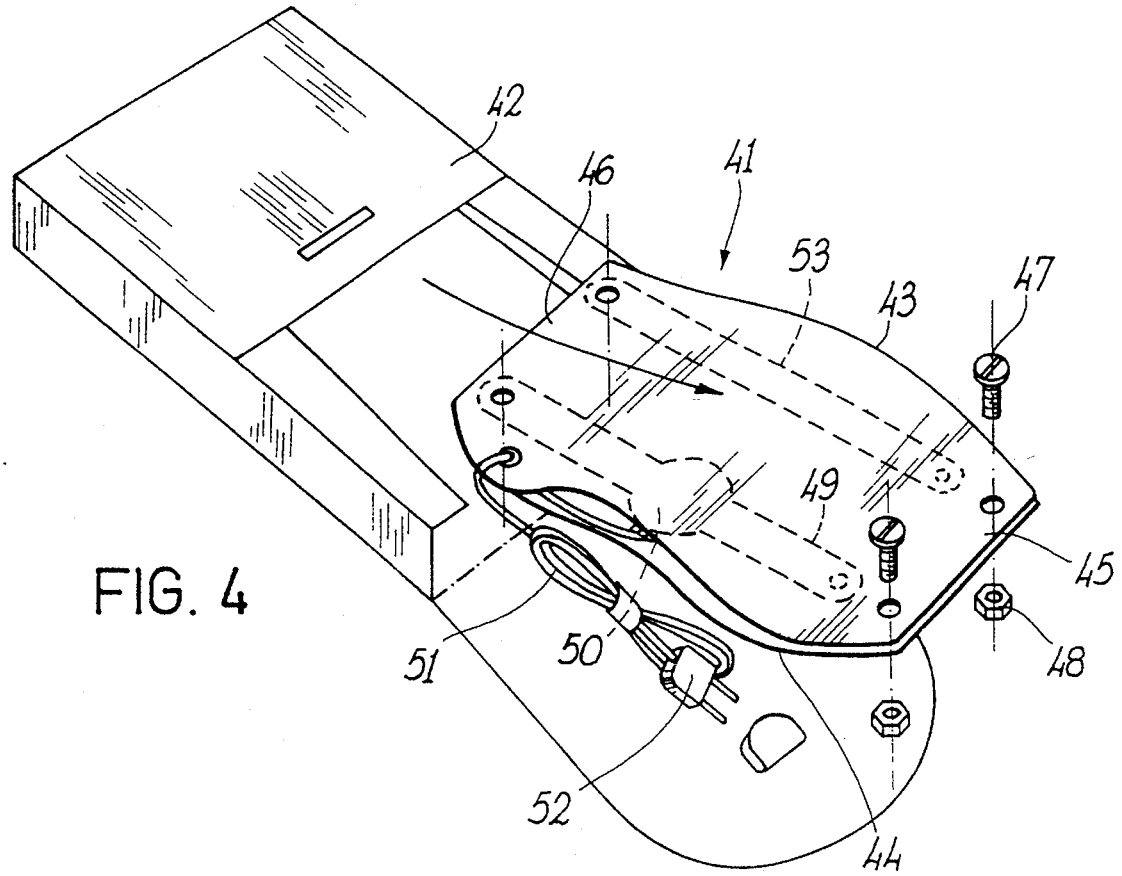
FIG. 4
FIG. 5
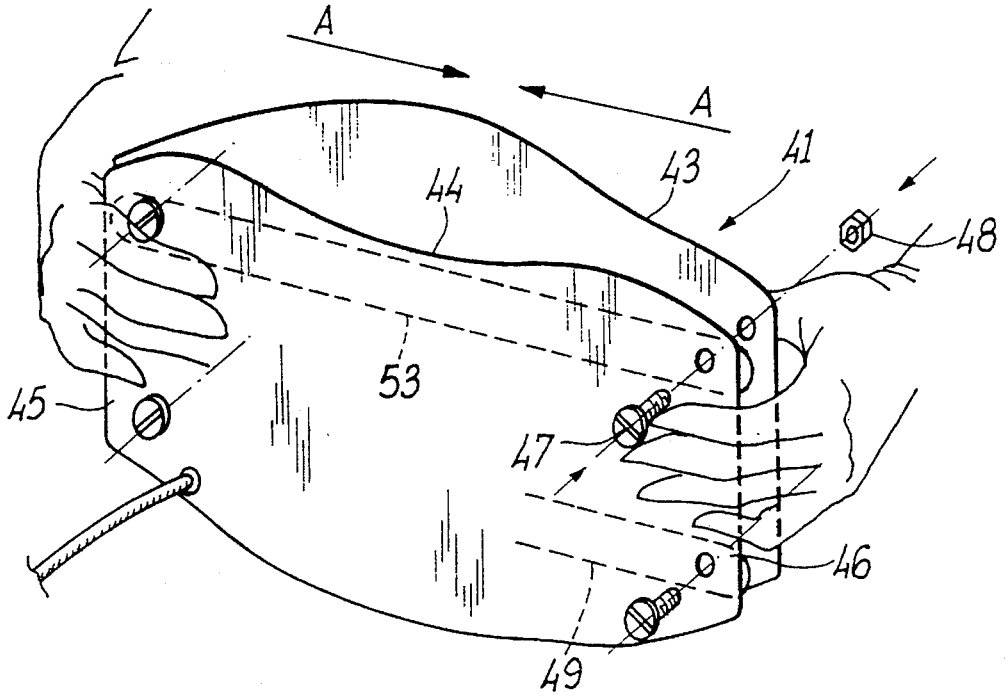

Fig. 8
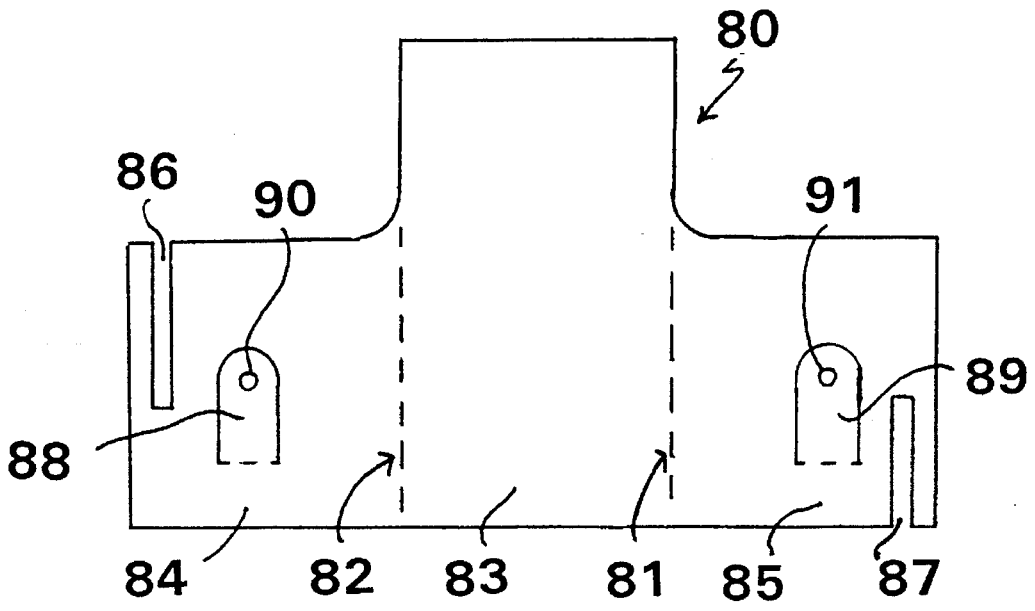
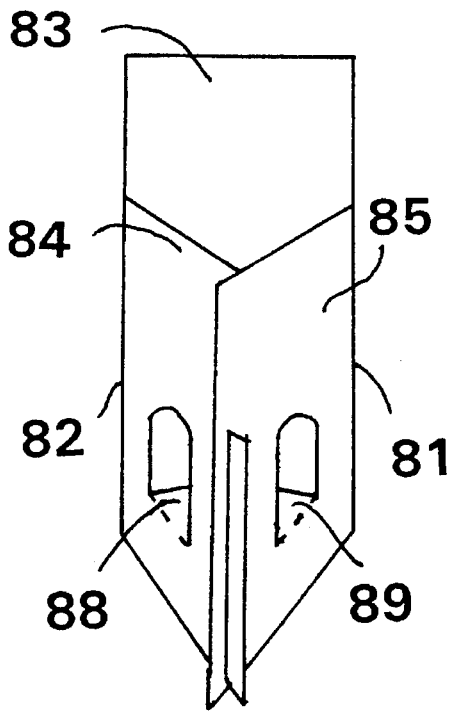
Fig. 9
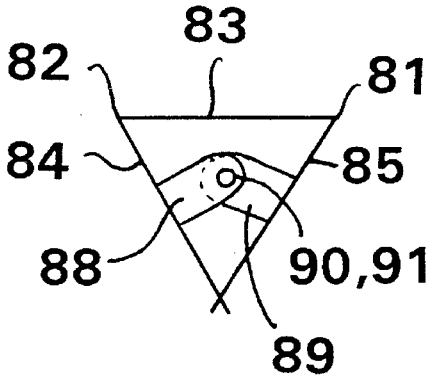
Fig. 10

LIGHTING APPARATUS SHIPPABLE IN A FLAT CONDITION

BACKGROUND OF THE INVENTION

The invention relates generally to lighting fixtures, and more particularly to lighting fixtures which are shippable in a flat condition and can be rapidly assembled by the user.

Lighting fixtures and lamp shades tend to be bulky and require large shipping containers for their transport. With conventional table top lighting fixtures, the lamp shades result in a large amount of dead space even if shipped stacked and separate from the lamp bases. Thus, especially for low cost lighting devices, a large proportion of the cost is expended in transport.

In this context, the present invention provides a lamp fixture that is structured in such a manner so that it may be sold in a packaging that is not bulky (which in turn translates into advantages both for the wholesalers and for the shops) and can be assembled by the end user easily without special technical skills or tools.

Moreover, the lamp fixtures of the present invention do not require a separate base structure, but rather are supported by the element which acts as their shades or housing (this element being capable of shipment in a flat condition which facilitates shipment and storage). The fixtures also meet the requirements of durability and safety which are indispensable for lighting and home furnishings.

SUMMARY OF THE INVENTION

The present invention concerns a lamp which can be assembled easily by the end user and is generally made up of a socket element, a housing element, and an internal element. The housing element is capable of assuming two positions: a shipping position, in which the housing is flat, and an assembled position, in which the housing element is not flat and is capable of supporting the lamp fixture. The socket element is supported by the internal element which in turns helps support the housing element to maintain its assembled position. Preferably, the housing element is composed of a front layer and a back layer which are coupled on at least two peripheral edges. In the assembled position these layers separate forming an internal space in which the internal element and the socket element are located.

BRIEF DESCRIPTION OF THE FIGURES

FIG. 4 shows a second embodiment of a lamp according to the invention before assembly FIG. 5 shows the assembly procedure of the lamp in FIG. 4

FIG. 8 shows an alternative embodiment of a housing element of a lamp according to the invention before assembling FIG. 9 shows the housing element of FIG. 8 in its folded, non-flat condition FIG. 10 shows a top view of the housing element of FIG. 9.

DETAILED DESCRIPTION OF THE INVENTION

Figure 1:
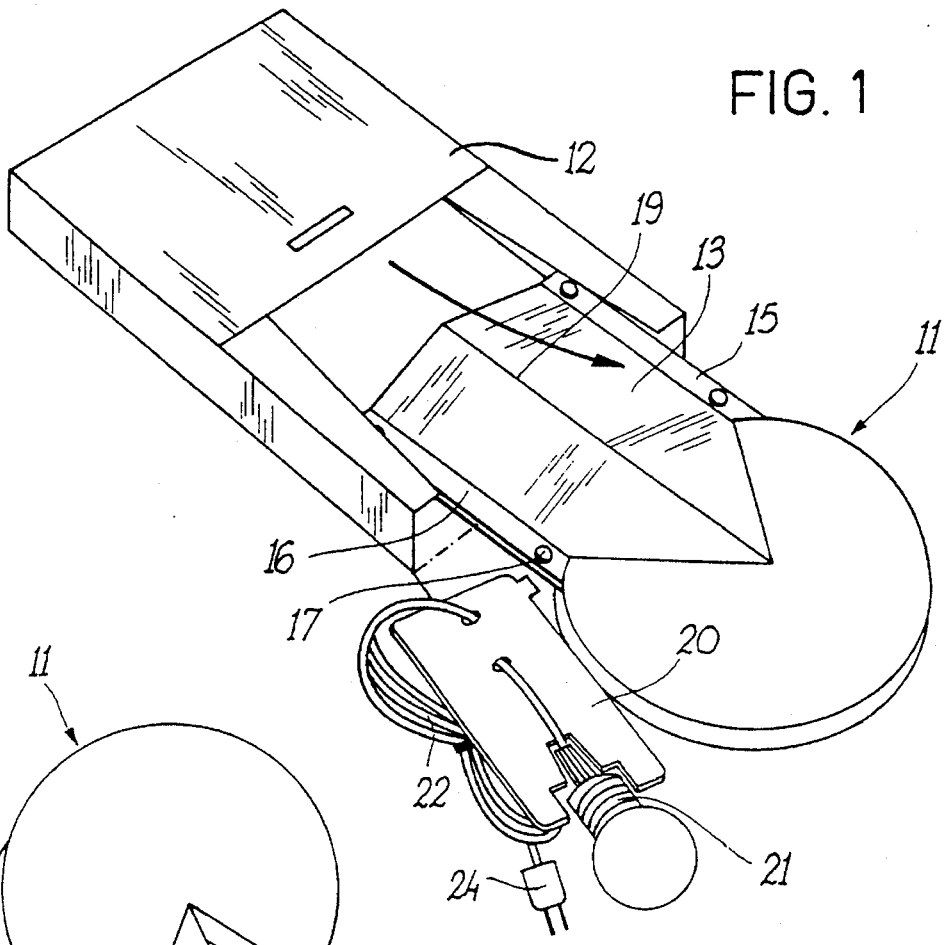
FIG. 1 shows one embodiment of a lamp according to the invention, before assembly

The present invention concerns a hand-assembled light fixture or lamp structure generally made up of a socket element, an internal element and a housing element. The socket element is standard in the lighting field and comprises a lamp holder, plug, connecting electrical wire, and a switch. Of course, it is also possible for the socket element to comprise a battery-operated lamp, thus eliminating the need for the electrical wire and the plug. The housing element, which is typically composed of a plastic material, is extremely simple and economical to manufacture with presently known production techniques and materials.

More particularly, the light fixture of the present invention comprises: (a) a light socket; (b) a housing for enclosing the light socket and providing a support base for the light fixture; (c) means for retaining the housing in an assembled position; and (d) means for securing the light socket in the housing. Preferably, the housing has at least two elements, a front layer and a back layer, attached at least at one peripheral edge. The front and back layers being movable from a first position wherein the layers are juxtaposed to a second or assembled position wherein the front and back layers are separated. The light socket is then secured in the space between the front and back layers.

In one embodiment the lamp fixture comprises two housing elements (the front and back layers) which are capable of being coupled along at least two vertical edges. These elements are made of a resilient deformable material, such as plastic, so that they can assume a shipping position (the first position), and an assembled position (the second position) when appropriate deforming pressure is applied. The fixture also comprises at least one internal support element that is inserted between the two housing elements and which helps to secure the elements in the assembled position. In some embodiments, two or more internal support elements are used. A light socket is then secured between the housing elements either by attachment to (or incorporation into) one of the internal support elements or one of the housing elements.

In the most preferred embodiment, the internal support element incorporates the means for securing the light socket; that is, the light socket attaches to or is part of the internal support element. It is contemplated, however, that the light socket may also be attached separately to the housing itself.

The coupling of the housing elements, e.g. the front and back layers, along at least one peripheral edge also serves to maintain the fixture in the assembled position. This coupling may be effected by any of the many well-known means for attachment, such as velcro, glue, clips, screws, nails, or other appropriate options. Preferably, coupling of the housing elements is effected with the use of nuts and bolts.

The housing elements are made typically of a material that allows for resilient deformation, such as plastic or more preferably polypropylene. Resilient deformability may be provided by the material itself (which allows bending or bowing, but returns to its original shape upon the relief of the deforming pressure) or by making the layers with marked or bending lines (in which case the elements bend along the marked lines when deforming pressure is applied).

In one embodiment, the internal element is sandwiched between and connected to the housing elements, is parallel to the bottom edge of the housing elements and is shorter in relationship to the width of these elements. The internal element is then coupled to the vertical edges of the housing elements when deforming pressure is applied so that the lamp structure takes on the assembled position.

The invention may also incorporate additional internal elements, preferably placed above the first, to help the lamp fixture take on the assembled position. These extra internal elements are coupled to the housing elements in a manner similar to the coupling of the first internal element. Any of the internal elements may carry the light socket or other electrical components.

In another embodiment, the internal element is perpendicular to the housing elements and maintains their separation while in the assembled position.

The housing elements may be furnished with designs or drawings to give the lamp a further aesthetic characteristic. It is also contemplated that the lamp fixture may be sold with several housing elements to allow the user to change the appearance of the lamp simply and economically. Moreover, it is contemplated that other electrical components or moving devices may be added to the fixture to improve or change its appearance. For instance, spinning devices which operate from the heat generated by the lamp may be incorporated in the interior space between the housing elements to improve appearance.

The present invention will now be described with reference to the Figures. This description is for illustration purposes and is not intended to, and should not be construed to, limit the invention as set forth in the claims which follow thereafter.

Figure 2:
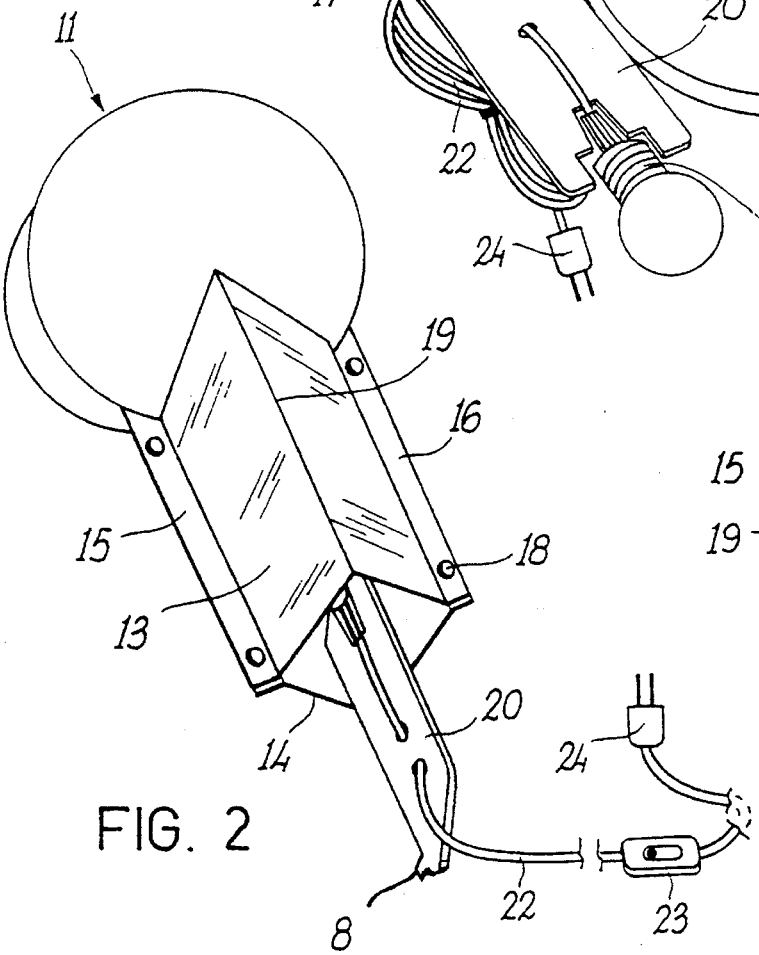
FIG. 2 shows the assembly of the lamp in FIG. 1
Figure 3:
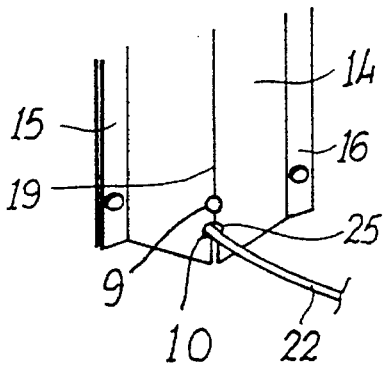
FIG. 3 shows a detail of the lamp in FIG. 1

With reference, first of all, to FIGS. 1 through 3, the lamp 11 shown is disassembled and contained in a box 12, which is not part of the invention and therefore will not be described further.

The lamp 11 is made of two side walls, 13 and 14, that are coupled along the vertical edges, 15 and 16, which are equipped with nuts, 17, and bolts, 18 for the coupling of the side walls 13 and 14. The side walls 13 and 14 are marked with bending lines 19 that will allow the lamp 11 to pass from the flattened position as in FIG. 1 to the assembled position as in FIGS. 2 and 3.

To maintain the position of FIGS. 2 and 3, the internal element 20 is inserted transversely, from bottom to top, and fitted between the side walls 13 and 14 so as to block the lamp in the open position. Element 20 is equipped with lamp holder 21, electrical wire 22, switch 23, and plug 24. The internal element 20 has a small extrusion 8 which secures the internal element in the proper position by insertion into small hole 9 located on the bottom of the back side wall 14. The back side wall 14 also has small hole 10 located near the bottom which allows electrical wire 22 to exit the internal area of the lamp.

With reference to FIGS. 4 and 5, lamp 41, originally held in a box 42 in the shipping position, is made of two side walls 43 and 44, coupled along the vertical edges 45 and 46 by means of bolts 47 and nuts 48. On the inside of the two side walls 44 and 45 there are a first internal element 49 that carries the electrical components 50, 51 and 52, and a second internal element 53. The two internal elements 49 and 53 are placed parallel to the side walls 43 and 44 and are attached to them by the same bolts 47 and nuts 48.

The two internal elements are shorter than the side walls 43 and 44 so that, in the assembly phase of lamp 41, it is necessary to compress the two side elements, as shown in FIG. 5, in the directions of the A arrows, so as to obtain the coupling of the internal elements 49 and 53 on both edges of the walls 43 and 44, thus putting the lamp 41 in the assembled position.

Figure 6:
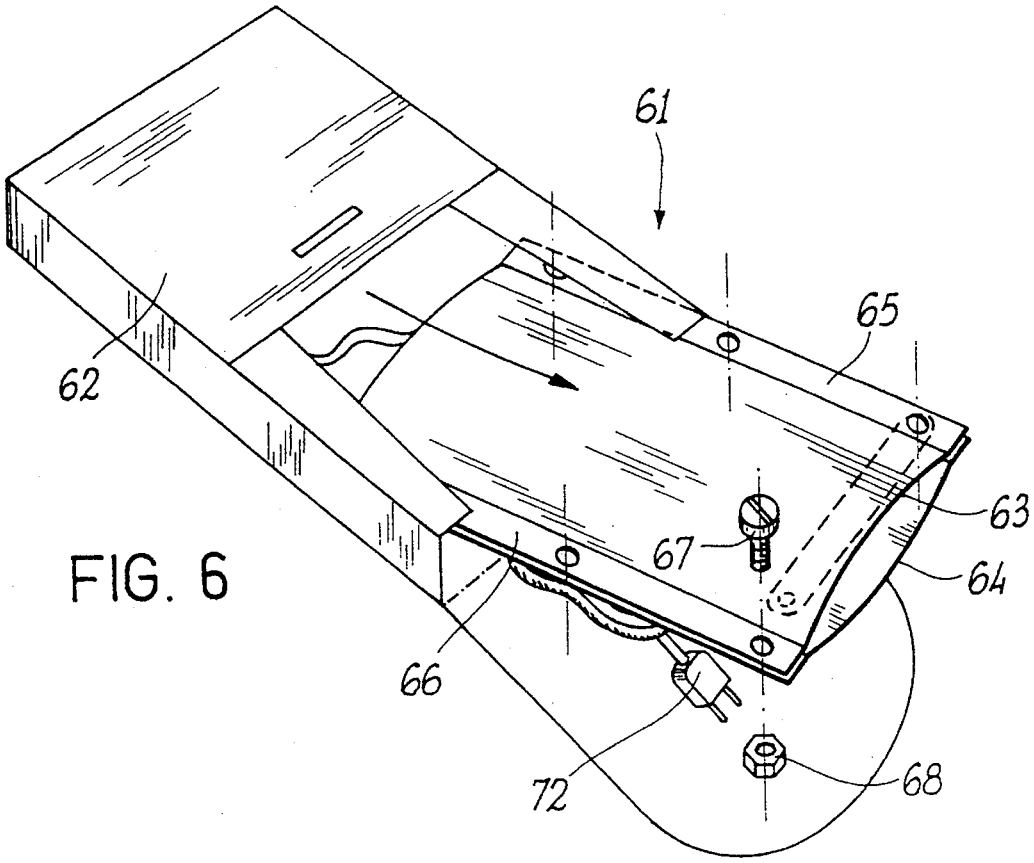
FIG. 6 shows a third embodiment of a lamp according to the invention before assembly
Figure 7:
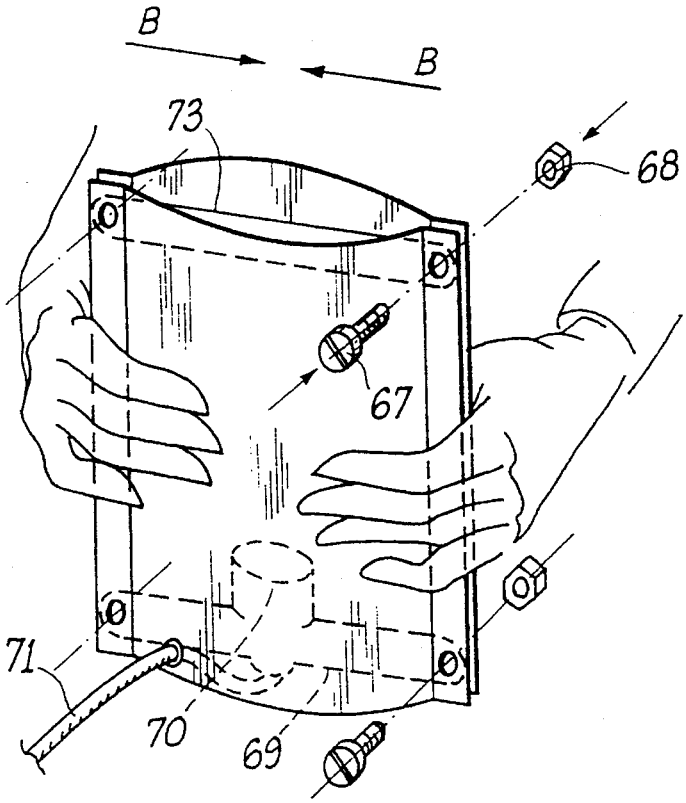
FIG. 7 shows the assembly procedure of the lamp in FIG. 6

FIGS. 6 and 7 show a third embodiment of lamps in accordance with the present invention. Lamp 61 is conceptually similar to lamp 41 in FIGS. 4 and 5. Lamp 61, which is originally contained in a box 62, has elements corresponding to those in lamp 41 and is assembled by means of the same operations.

The lamp has two side walls 63 and 64, coupled along the vertical edges 65 and 66 by means of bolts 67 and nuts 68, and has two internal elements 69 and 73, which are shorter than the side walls. Internal element 69 carries electrical elements 70, 71 and 72. As before, assembly requires a compression in the direction of the B arrows, as shown in FIG. 7.

FIGS. 8–10 show an alternative embodiment of the invention. In this embodiment, the fixture comprises a socket element and a housing element that consists of a single sheet of paper, cardboard, plastic or similar material having marked or bending lines so that it is capable of being folded into a flat condition and into a non-flat condition. In the flat condition, the fixture may be shipped in an envelope. In the non-flat condition, the housing element is folded so that it forms a stable support base for the fixture and an interior space in which the socket element may be secured. The housing element also comprises means for securing the socket element.

Referring to the specific example shown in FIGS. 8–10, the housing element may comprise a single sheet of cardboard or plastic (80) having two bending lines (81 and 82) so as to form three panels: a middle panel (83) and two outer panels (84 and 85). The housing element is folded along bending lines 81 and 82 so that an interior space is formed when the outer edges of outer panels 84 and 85 are secured together. One means for securing these edges together is by an interlocking tab and slot arrangement (86 and 87) as shown in the figures. Of course, many other means of securing these edges together are known to those skilled in the art. Outer panels 84 and 85 also incorporate means of securing the socket element (not shown) in the interior space. In the embodiment shown, the panels possess fold down tabs 88 and 89 which have circular openings 90 and 91 into which the socket element is placed when the openings are overlapped.

The current invention has been described above for illustration according to its preferred embodiments. Upon reading the subject disclosure, various embodiments will become obvious to those skilled in the art. These variations are to be considered within the scope and spirit of the subject invention, which is only to be limited by the claims which follow and their equivalents.

What is claimed is:

1. A lamp fixture which comprises:

(a) a light socket;

(b) a housing for enclosing the light socket and providing a support base for the light fixture, the housing having a front layer and a back layer, the front layer and the back layer being attached at least at one peripheral edge by a series of nuts and bolts, the front and back layers being movable from a first position wherein the layers are juxtaposed to a second position wherein the front and back layers are separated to form a stable vertical unit;

(c) means for retaining the front layer and the back layer in the second position; and (d) means for securing the light socket in the space between the front and the back layers when the front and the back layers are in the second position.

2. A lamp fixture of claim 1, wherein the means for retaining the front layer and the back layer in the second position incorporates the means for securing the light socket in the space between the front layer and the back layer.

3. A lamp fixture of claim 1, wherein the front and back layers possess marked lines along which the layers bend to allow the layers to be moved into the second position.

4. A lamp fixture of claim 1, wherein the front and back layers are made of a plastic material.

5. A lamp fixture of claim 4, wherein the front and back layers are made of polypropylene.

6. A lamp fixture of claim 1, wherein the means for retaining the front and back layers in the second position comprises an internal element which contacts the front and back layers and is located in the space between the front and back layers.

7. A lamp fixture of claim 6, wherein the internal element is essentially parallel to one edge of each of the front and back layers, is shorter than the width of said layers, and is removably attached to the front and back layers when in the second position.

8. A lamp fixture of claim 6, wherein the internal element is essentially perpendicular to one edge of each of the front and back layers.

9. A lamp fixture of claim 6, wherein the internal element supports the light socket.

10. A lamp fixture comprising:

(a) two housing elements capable of being coupled along at least two edges to form a support base for the lamp fixture, said housing elements being made of a resilient deformable material so that the elements can assume a shipping position and an assembled position;

(b) an internal element that is capable of being inserted between the two said housing elements and which secures the elements in the assembled position when the elements are coupled to one another; and (c) means for securing a light socket in between the housing elements when the elements are in the assembled position.

11. A lamp fixture of claim 10, wherein the housing elements are coupled along two edges by a series of nuts and bolts.

12. A lamp fixture of claim 10, wherein the internal element incorporates means for securing the light socket.

13. A lamp fixture of claim 10, wherein the internal element is essentially parallel to a bottom edge of the housing elements and is sandwiched between the elements when they are coupled along at least two edges.

14. A lamp fixture of claim 10, wherein the internal element is essentially perpendicular to a bottom edge of the housing elements.

15. A lamp fixture of claim 10, wherein the internal element supports the light socket.

16. A lamp fixture which comprises:

(a) a light socket;

(b) a housing for enclosing the light socket and providing a support base for the light fixture, the housing having a front layer and a back layer, the front layer and the back layer being attached at least at one peripheral edge, the front and back layers being movable from a first position wherein the layers are juxtaposed to a second position wherein the front and back layers are separated to form a stable vertical unit;

(c) means for retaining the front layer and the back layer in the second position comprising an internal element which contacts the front and back layers and is located in the space between the front and back layers; and (d) means for securing the light socket in the space between the front and the back layers when the front and the back layers are in the second position.

17. A lamp fixture of claim 16, wherein the means for retaining the front layer and the back layer in the second position incorporates the means for securing the light socket in the space between the front layer and the back layer.

* * * * *